United States Patent [19]

Grat

[11] 4,052,174

[45] Oct. 4, 1977

[54] APPARATUS FOR SHARPENING BLADE EDGES

[75] Inventor: Felix R. Grat, Lake Hiawatha, N.J.

[73] Assignee: Hacker Instruments, Inc., Fairfield, N.J.

[21] Appl. No.: 664,828

[22] Filed: Mar. 8, 1976

[51] Int. Cl.[2] ..... B24B 3/36; B24B 3/50

[52] U.S. Cl. ..... 51/81 BS; 51/82 BS; 51/84 BS

[58] Field of Search ..... 51/74 BS, 80 A, 80 BS, 51/82 R, 82 BS, 84 R, 84 BS, 85 R, 85 BS, 86 R, 86 BS, 92 BS, 165.72, 81 R, 81 BS

[56] References Cited

U.S. PATENT DOCUMENTS

| | | | |
|---|---|---|---|
| 1,102,706 | 7/1914 | Winter | 51/85 BS |
| 1,143,383 | 6/1915 | Green | 51/86 BS |
| 1,178,400 | 4/1916 | Jones | 51/84 R |
| 1,420,656 | 6/1922 | Gutekunst | 51/84 BS |
| 1,918,111 | 7/1933 | Kohlmiller | 51/84 BS X |
| 3,859,762 | 1/1975 | Ludwig | 51/81 BS X |
| 3,895,462 | 7/1975 | Garin | 51/85 BS |

FOREIGN PATENT DOCUMENTS

| | | | |
|---|---|---|---|
| 191,285 | 8/1937 | Switzerland | 51/80 BS |

*Primary Examiner*—Al Lawrence Smith
*Assistant Examiner*—Nicholas P. Godici
*Attorney, Agent, or Firm*—Thomas N. Neiman

[57] ABSTRACT

In one depicted embodiment of the invention the apparatus comprises a base on which a pair of honing wheels of a given, common diameter, and a pair of stropping wheels of another, common diameter are supported and rotatively driven — the pairs being spaced apart from each other, and the wheels of each pair also being spaced therebetween. A blade support is carried on rails for pendantly carrying a blade and moving the blade across the peripheral faces of the wheels, the rails being arranged above the wheels. The honing wheels diameter is greater than that of the stropping wheels, thus as the blade is stroked across the honing wheels the latter engage and hone the full blade edge, whereas with the blade being stroked across the stropping wheels, the latter engage and strop only the furthermost tip portion of the blade edge. Other rails disposed penpendicular to said first-mentioned rails provide for the movement of the blade support, and the blade, across the spaces obtaining between the wheel pairs whereby, alternatively, one side of the blade edge, and then the side opposite, can be honed and stropped. The blade support includes a translatable blade holder, in order that the bevel and depth of the blade edging can be altered, as well as a gauge movable by the translatable blade for indicating the bevel angle adjustment.

13 Claims, 3 Drawing Figures

APPARATUS FOR SHARPENING BLADE EDGES

This invention pertains to blade sharpening apparatus, and in particular to apparatus of that type for both honing and stropping blades, such as microtome blades and the like, which have beveled edges on opposite sides thereof. It is an object of this invention to set forth an improved apparatus for sharpening blade edges. Especially, it is an object of this invention to disclose apparatus for sharpening blade edges comprising a base, a pair of honing wheels supported on said base for rotation in parallel axes on a common plane, said wheels being spaced apart to define a given void therebetween, means coupled to said wheels for driving the latter in rotation, and means coupled to said base for replaceably supporting a blade, pendantly, only in planes normal to said common plane, wherein said blade supporting means includes means for moving said blade in directions parallel to said axes and along said normal plane, and in direction transverse to said axes and through said given void, to cause said blade to sweep contactingly, and independently, across one of said wheels to effect honing of one blade -edge side, and across the other of said wheels to effect honing of an opposite blade-edge side.

Further objects of this invention, as well as the novel features thereof, will become more apparent by reference to the following description taken in conjunction with the accompanying figures, in which.

Figure 1:
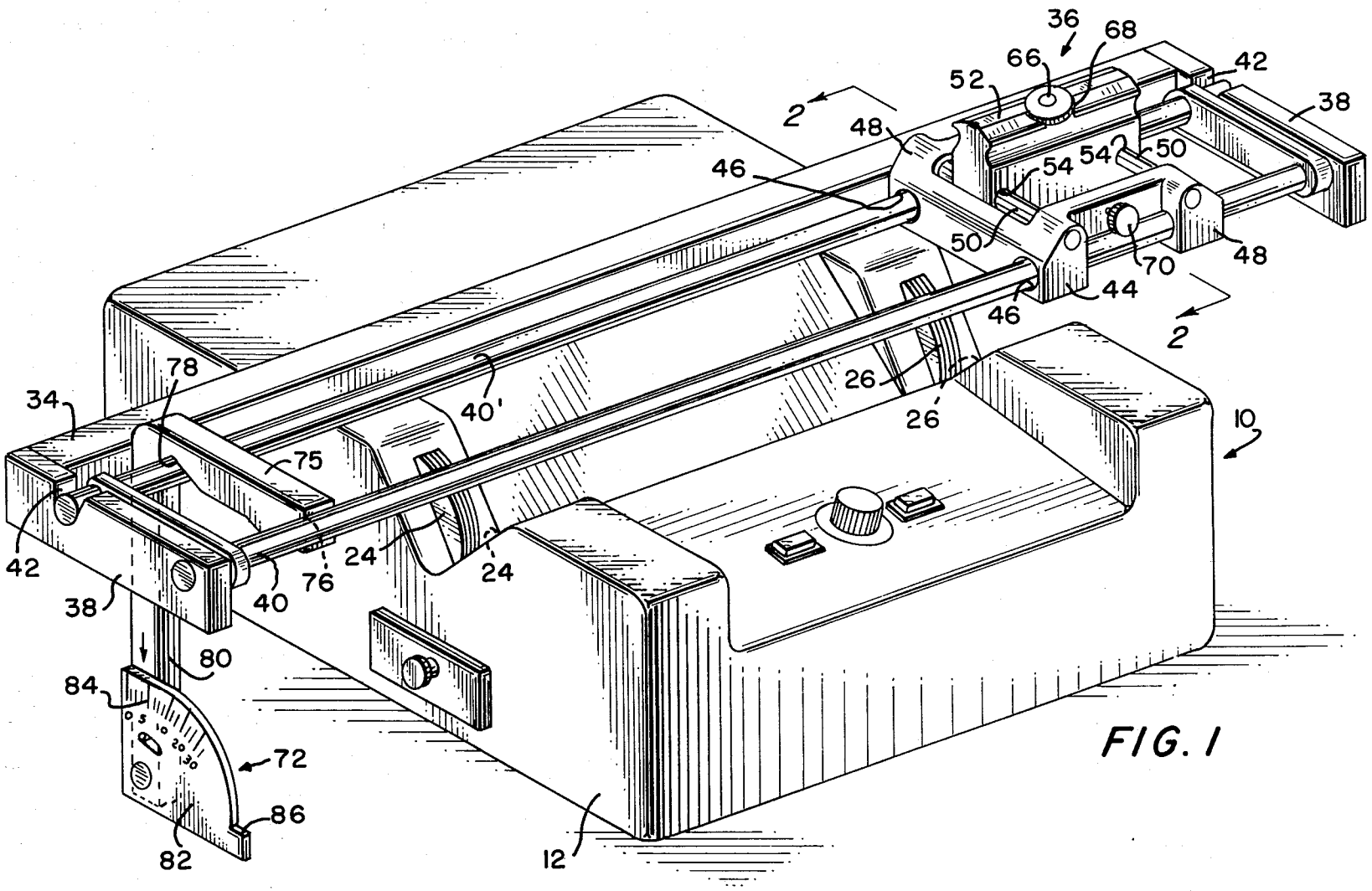
FIG. 1 is an isometric projection of a first embodiment of the invention.
Figure 2:
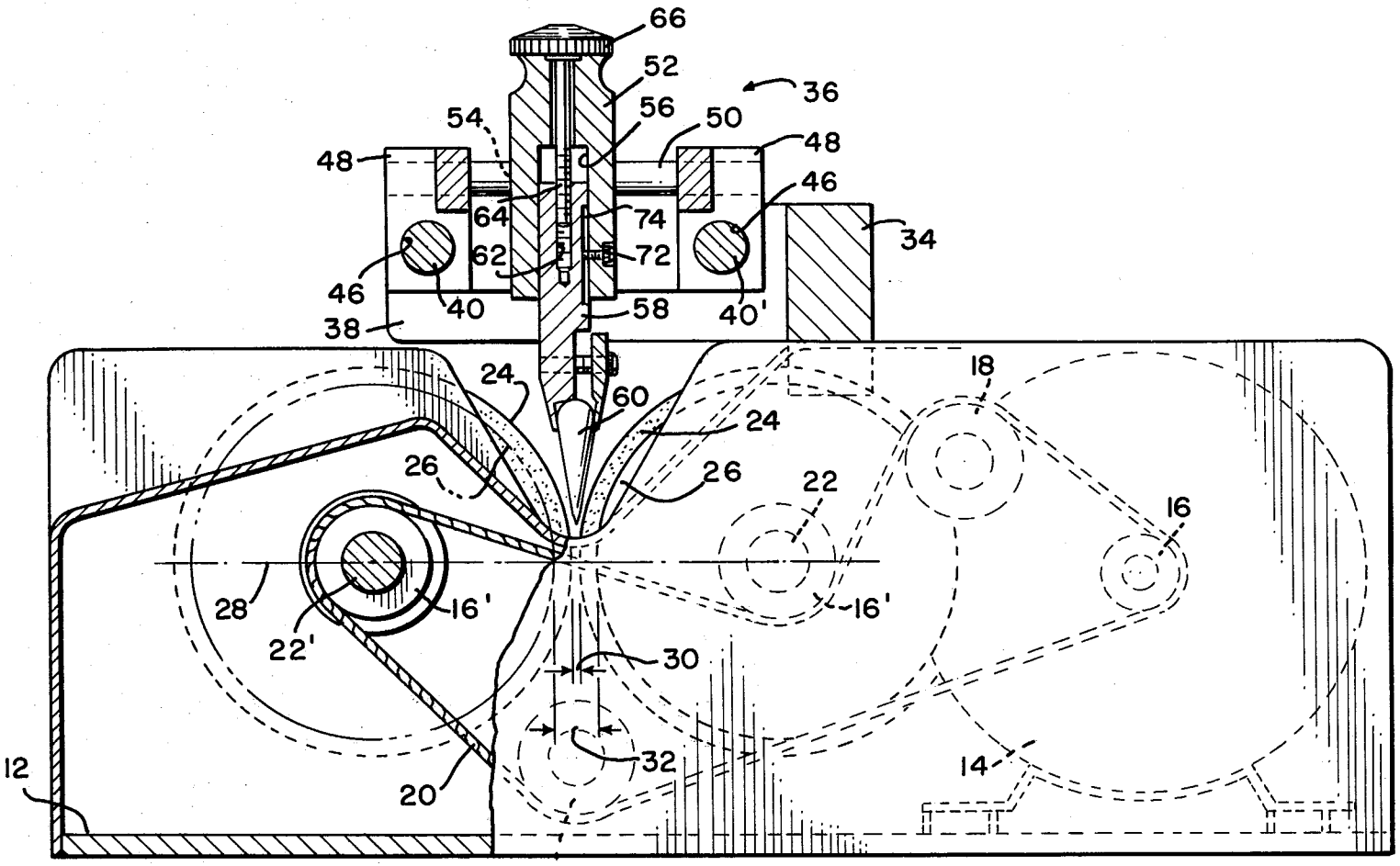
FIG. 2 is a cross-sectional view, in elevation, taken across the median of the blade support of the FIG. 1 embodiment.

As shown in FIGS. 1 and 2, the apparatus 10, according to the first embodiment thereof, comprises a base 12 which encloses a motor 14. By means of pulleys 16 and 16′ and idlers 18, motor 14 moves an endless belt 20 to drive shafts 22 and 22′ to which a pair of honing wheels 24 and a pair of stropping wheels 26 are secured. Honing wheels 24 are of common, given diameter, and rotate with the shafts 22 and 22′ in parallel axes on plane 28, yet they are spaced apart from each other, defining a void 30 therebetween. So also, stropping wheels 26 are of a common diameter, albeit smaller than that of wheels 24; they too are spaced apart from each other, to define the void 32 therebetween.

Base 12 mounts a crossbar 34 which, in cantilever fashion, mounts a blade support assembly 36. Assembly 36 comprises support plates 38, at opposite ends thereof, which rotatively support a first of two parallel rods 40 and 40′ and nestingly receive the second thereof in notches 42 formed therein.

A carriage 44, which defines a substantially rectangular frame, has a pair of throughgoing bores 46 formed therein slidably to receive the rods 40 and 40′. Mirror-image limbs 48 of carriage 44 further mount transverse rods 50 which slidably support a blade-mounting body 52. Body 52 has a pair of parallel bores 54 through which the rods 50 penetrate.

Body 52 is formed with a channel 56 therein. A blade holder 58 clamps a blade 60 between the jaws thereof, at one end thereof, and an opposite end thereof is slidably engaged with the channel 56. Too, the opposite end has a tapped hole formed therein, the same denoted by index number 62, to receive a threaded end of a rod 64. Rod 64 has an unthreaded shank which is rotatably journalled in a bore provided therefor in body 52. The outermost, exposed end of rod 64 terminates in a knurled head 66 which is received in a recess 68 in body 52.

Set screws 70 (only one of which is shown) penetrate the limbs 48, and are selectively adjustable to delimit the travel of body 52 along rods 50. The further set screw 72 is provided to have the inner end thereof engage ends of a trough 74 formed in blade holder 58 to delimit the total blade translation.

In operation of the apparatus 10, the body 52 is grasped by hand and moved to the left (with respect to FIG. 1), and moved rearward — to cause the blade 60 to sweep along the rear honing wheel 24, and to hone the rear blade edge. Then, upon the blade 60 having cleared the rear honing wheel 24, the body 52 is moved forward — and to the right, to cause the blade 60 to sweep along the front honing wheel 24. Initially, however, to insure an optimum engagement of the blade 60 with the wheels 24, and to prevent an impingement of the blade 60 with a side surface of the wheels 24, the blade 60 is moved along rods 40 and 40′ until it is within the void 30. Then it is moved rearward, along rods 50, until it just touches the rear wheel 24. The set screw 70, at the rear, is then adjusted to delimit the rearward travel of the body 52 to this lateral translation. Next the same is done to delimit the lateral travel of the body (and blade 60) relative to the front wheel 24, the front set screw 70 being used to set the permitted frontwise travel of the body to a touching-engagement of the blade 60 with the front honing wheel 24.

Rods 40 and 40′ are supported only at the terminal axial ends thereof, and in that they are sufficiently resilient, it remains only a matter of applying more and more hand pressure, transverse to the axes of the rods 40 and 40′, as the blade is repeatedly stroked across the wheels 24, to cause the blade 60 to be brought into more intimate contact with the wheels 24. Thus, be gently increasing this transverse pressure, with successive strokes of the blade across the wheels 24, the latter are caused to hone the blade more deeply.

The same circumstances arise with the sweeping of the blade 60 across the stropping wheels 26. Here, however, due to the smaller diameter of wheels 26, the set screws 70 must be used again to predetermine the sidewise travel of the body 52 and blade 60 to just-touching engagement with the wheels 26, prior to repetitive stroking of the blade 60 across the wheels 26 for stropping thereof.

As can be appreciated, the body 52 and blade 60 move axially along rods 40 and 40′, and forward and rearward along rods 50 within limits set by set screws 70. However, the blade 60 is adjusted for translation relative to body 52, and penetration into voids 30 and 32, according to the adjustment of knurled head 66 and rod 64. So too, such adjustment determines the depth of honing of the edge of the blade 60 and, concomitantly, the angle of the blade-edge bevel. Clearly, as the blade is deeply set into the void 30, the honing wheels 24 will grind a deep blade edge of shallow bevel angle; alternatively, if the blade is set less deeply into the void 30, the honing wheels 24 will grind a narrower blade edge of a more gross bevel angle.

In order that the bevel angle to be honed on the blade 60 can be predetermined before the honing is commenced, gauging means 72 are provided. Said gauging means comprises a dog-leg shaped arm 75 which has a recess 76 at one end of a limb thereof for engaging rod 40 and a relief 78 for engaging the parallel rod 40'. A depending limb 80 thereof carries a pivotally-movable scale 82. Scale 82 is inscribed with blade bevel-angle markings 84. The markings or indicia 84 signify the beveling to be achieved on the blade 60, depending upon the degree of movement thereof toward the common plane 28; the more proximate to the plane 28, the shallower the bevel angle, and the more distant the blade 60 from the plane 28, the deeper will be the bevel angle.

Scale 82 has a tongue 86 projecting therefrom which is axially aligned with the blade 60. Thus, by rotating knurled head 66, the blade can be advanced toward scale 82 (having been pre-positioned thereover) to cause a depressing of tongue 86. So also, knurled head 66 can be rotated to retract the blade 60 to allow the scale 82 to rotate in a counter-clockwise direction. Spring means (not shown) urge the scale 82 in said counter-clockwise direction, requiring a downward translation of the blade 60 to overcome the spring biasing.

Patently, in view of the diverse diameters of the honing wheels 24 and stropping wheels 26, a setting of the knurled head 66 will address the blade edges to the first wheels at a predetermined angle; then, the stropping wheels will dress only the foremost, leading portion of the blade edges. The relationship between the address of the honing wheels 24 and stropping wheels 26 is permanently established by the diverse diameters of each and the rotation of all said wheels on common axes, vis-a-vis the selected translation of the blade 60 relative to the common plane 28. Further, as described, the translation of the blade 60 relative to the common plane 28 is determined by the setting of the knurled head 66 — with the predetermined beveling-angle setting readable on scale 82.

Figure 3:
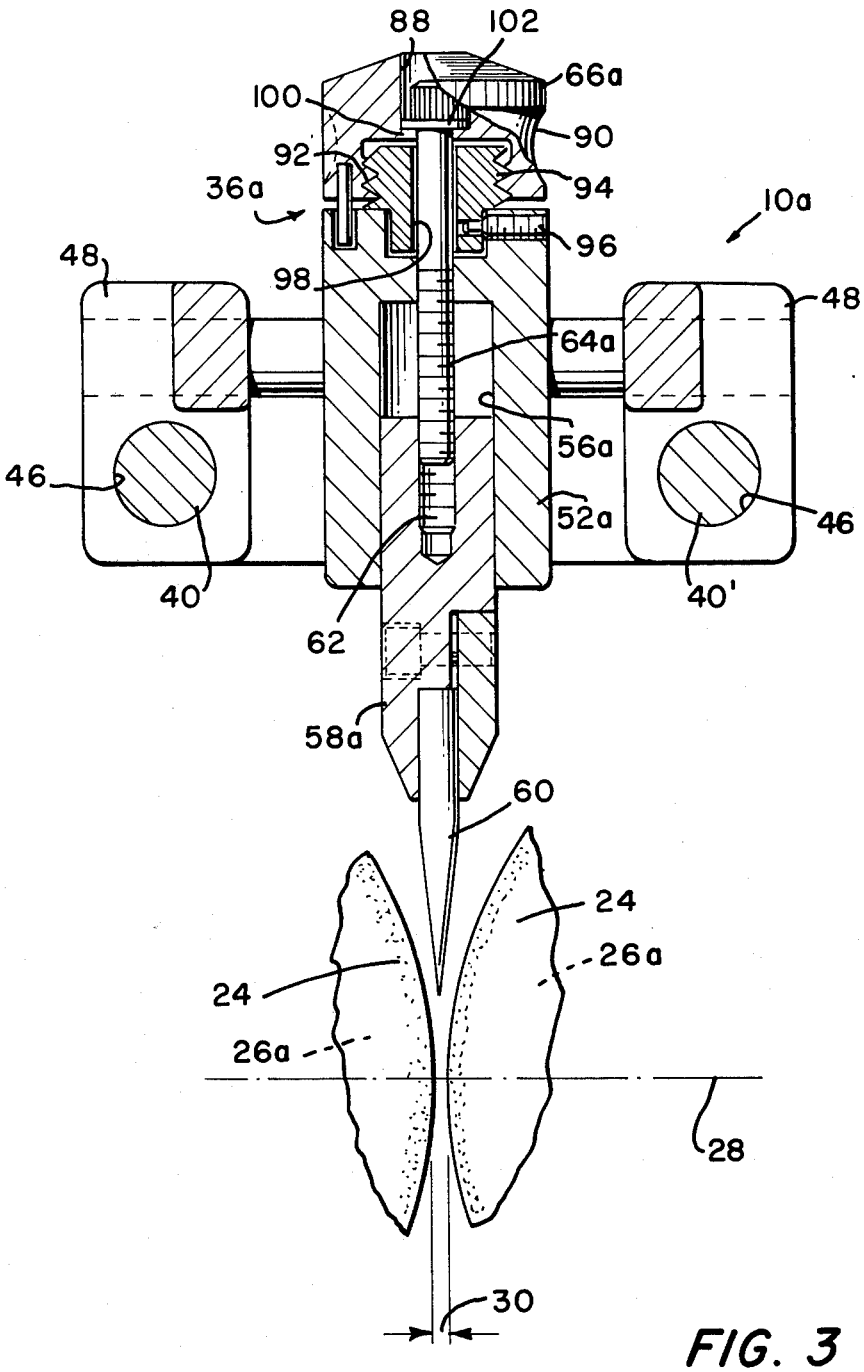
FIG. 3 is a cross-sectional view, in elevation, of an alternative embodiment of the invention, the same depicting the blade support arrangement and portions of the honing and stropping wheels.

An alternative embodiment of the invention is shown, only in part, in FIG. 3. All else being the same as in apparatus 10 (of FIGS. 1 and 2), only so much of alternative apparatus 10*a* which is varied is shown in FIG. 3; this comprises a different arrangement for translating the blade 60, and the common diameter of all wheels — honing and stropping.

In this embodiment, this alternative apparatus 10*a,* where all the wheels 24 and 26*a* are of common diameter, the varied arrangement for translating the blade 60 is necessary. In this arrangement, the knurled head 66*a* has a central bore 88 which provided operative access to the primary blade translating element, socket-headed screw 64*a.* The head 66*a* is integral with a nut 90 which has a coarse thread 92 formed therein. Thread 92 receives a correspondingly threaded stub 94 which, by means of a set screw 96, is fixed to body 52*a* (to render stub 94 stationary). Stub 94 has a bore 98 through which the screw 64*a* is freely rotatable. Too, nut 90 has a shoulder 100 which receives a washer 102 which is integral with the socket head of the screw 64*a.*

In order to set the depth of the blade 60, relative to the plane 28, it is necessary only to turn the screw 64*a.* As described in connection with apparatus 10, here too the scale 82 can be used to determine the desired bevel angle. However, in this embodiment, where both wheels 24 and 26 are of common diameter, and share a common void 30, a re-setting of the depth of the blade must be accomplished following honing and prior to stropping. This is made possible through the coarse-threaded relationship between the nut 90 and stub 94. By rotating the nut 90 in a clockwise direction, it moves axially along the stub 94, rising relative thereto. So also, the shoulder 100 carries the washer 102 and screw 64*a* with the blade holder 58*a* and blade 60 upward. Indexing means (not shown) visually inform the user of the apparatus 10*a* when the nut 90 has been rotated sufficiently to insure optimum stropping of the blade 60. Accordingly, by the use of a socket wrench (or equivalent) on the head of the screw 64*a,* the desired honing depth of the blade 60 can be effected. Then, by turning the nut 90 to an indexed setting, in a clockwise direction, the proper blade depth for stropping is established. On proceeding to set the honing depth, of course, it is necessary that the nut 90 be closed upon the body 52*a* (i.e., turned down, thereto, in a counter-clockwise direction), before setting the screw 64*a.*

While I have described my invention in connection with specific embodiments thereof, it is to be clearly understood that this is done only by way of example and not as a limitation to the scope thereof, as set forth in the objects thereof and in the appended claims.

I claim:

1. Apparatus for sharpening blade edges, comprising:

a base;

a pair of honing wheels supported on said base for rotation in parallel axes on a common plane;

said wheels being spaced apart to define a given void therebetween;

means coupled to said wheels for driving the latter in rotation; and means coupled to said base for replaceably supporting a blade only perpendicular to said common plane; wherein said blade supporting means includes means for moving a blade supported thereby in directions parallel to said axes, and in directions transverse to said axes and through said given void, to cause such a supported blade to sweep contactingly, and independently, across one of said wheels to effect honing of one blade-edge side, and across the other of said wheels to effect honing of an opposite blade-edge side;

said blade supporting means comprising means for replaceably clamping and securing a blade thereto, said latter means having ways formed therein which extend longitudinally parallel with said axes, and guides also extending longitudinally parallel with said axes, said ways being slidably engaged with said guides; and said guides are resilient, and are supported only at opposite longitudinal ends thereof, and yield under manual pressure applied to said blade supporting means transverse to said axes to move a blade supported thereby into greater contact with said wheels.

2. Apparatus, according to claim 1, further including:

means supported by said base for stropping said blade-edge sides.

3. Apparatus, according to claim 1, further including:

a pair of stropping wheels supported on said base for rotation in parallel axes and on said common plane in a spaced-apart location from said honing wheels;

said stropping wheels being spaced apart to define a void therebetween which is greater than said given void; and means coupled to said stropping wheels for driving the latter in rotation; and wherein said blade moving means comprises means for causing opposite blade-edge sides of a blade supported by said supporting means also to sweep contactingly, and independently, across one of said stropping wheels to effect stropping of only a portion of one blade-edge side, and across the other of said stropping wheels to effect a stropping of only a portion of an opposite blade-edge side.

4. Apparatus, according to claim 3, wherein:

said honing wheels are of one common diameter, and said stropping wheels are of another common diameter.

5. Apparatus, according to claim 4, wherein:

said one common diameter is greater than said another common diameter.

6. Apparatus, according to claim 1, wherein:

said blade supporting means further comprises courses formed in said blade-clamping and -securing means, said courses lying linearly normal to said axes, and rails also extending linearly normal to said axes, said courses being slidably engaged with said rails; and further including means carried by said blade supporting means selectively adjustable for delimiting a travel of said courses along said rails.

7. Apparatus, according to claim 3, wherein:

said honing wheels and said stropping wheels are all of one common diameter.

8. Apparatus for sharpening blade edges, comprising:

a base;

a pair of honing wheels supported on said base for rotation in parallel axes on a common plane;

said wheels being spaced apart to define a given void therebetween;

means coupled to said wheels for driving the latter in rotation; and means coupled to said base for replaceably supporting a blade only perpendicular to said common plane; wherein said blade supporting means includes means for moving a blade supported thereby in directions parallel to said axes, and in directions transverse to said axes and through said given void, to cause such a supported blade to sweep contactingly, and independently, across one of said wheels to effect honing of one blade-edge side, and across the other of said wheels to effect honing of an opposite blade-edge side;

said blade supporting means further including means for translating a blade supported thereby into and out of proximity with said common plane, to cause said blade-edge sides to contact said wheels at diverse, acute angular displacements from said common plane to cause blade-edge honing along greater and lesser blade-edge depths and with concomitant lesser and greater blade-edge tapering; and further including gauging means coupled to said base and disposed for impingement of a blade supported by said supporting means therewith, for gauging said angular displacements;

said gauging means having means cooperative with said blade translating means, and movable in response to blade contact therewith and translation of a supported blade, to indicate angular displacements with which said blade-edge sides will contact said wheels at given supported -blade translations.

9. Apparatus, according to claim 8, wherein:

said gauging means comprises means for visually indicating said angular displacements with indicia representative of blade-edge tapering.

10. Apparatus for sharpening blade edges, comprising:

a base;

a pair of honing wheels supported on said base for rotation in parallel axes on a common plane;

said wheels being spaced apart to define a given void therebetween;

means coupled to said wheels for driving the latter in rotation; and means coupled to said base for replaceably supporting a blade only perpendicular to said common plane; wherein said blade supporting means includes means for moving a blade supported thereby in directions parallel to said axes, and in directions transverse to said axes and through said given void, to cause such a supported blade to sweep contactingly, and independently, across one of said wheels to effect honing of one blade-edge sides, and across the other of said wheels to effect honing of an opposite blade-edge side;

said blade supporting means further including means for translating a blade supported thereby into and out of proximity with said common plane, to cause said blade-edge sides to contact said wheels at diverse, acute angular displacements from said common plane to cause blade-edge honing along greater and lesser blade-edge depths and with concomitant lesser and greater blade-edge tapering; and said blade translating means comprises a body having a channel formed therein, a blade holder having a portion thereof slidably engaged with said channel, said blade holder having a tapped hole formed therein normal to said common plane, and a threaded rod in penetration of said body and threadedly engaged with said tapped hole, said threaded rod having a head formed on an end thereof which is nested in a recess provided therefor in said body.

11. Apparatus for sharpening blade edges, comprising:

a base;

a pair of honing wheels supported on said base for rotation in parallel axes on a common plane;

said wheels being spaced apart to define a given void therebetween;

means coupled to said wheels for driving the latter in rotation; and means coupled to said base for replaceably supporting a blade only perpendicular to said common plane; wherein said blade supporting means includes means for moving a blade supported thereby in directions parallel to said axes, and in directions transverse to said axes and through said given void, to cause such a supported blade to sweep contactingly, and independently, across one of said wheels to effect honing of one blade-edge side, and across the other of said wheels to effect honing of an opposite blade-edge side;

said blade supporting means further includes means for translating a blade supported thereby into and out of proximity with said common plane, to cause said blade-edge sides to contact said wheels at diverse, acute angular displacements from said common plane to cause blade-edge honing along greater and lesser blade-edge depths and with concomitant lesser and greater blade-edge tapering; further including a pair of stropping wheels supported on said base for rotation in parallel axes and on said common plane in a spaced-apart location from said honing wheels;

said stropping wheels being spaced apart to define a void therebetween which is greater than said given void;

means coupled to said stropping wheels for driving the latter in rotation; and wherein said blade moving means comprises means for causing opposite blade-edge sides of a blade supported by said supporting means also to sweep contactingly, and independently, across one of said stropping wheels to effect stropping of only a portion of one blade-edge side, and across the other of said stropping wheels to effect a stropping of only a portion of an opposite blade-edge side;

said honing wheels and said stropping wheels are all of one common diameter; and said blade translating means comprises both first and second means for translating a supported blade into and out of proximity with said common plane.

12. Apparatus, according to claim 11, wherein:

said first means is selectively operative independent of said second means; and said first and second means have means cooperative for effecting translation of said first means coincident with operation of said second means, whereby operation of said second means effects translation of both said first means and a supported blade.

13. Apparatus for sharpening blade edges, comprising:

a base;

a pair of honing wheels supported on said base for rotation in parallel axes on a common plane;

said wheels being spaced apart to define a given void therebetween;

means coupled to said wheels for driving the latter in rotation; and means coupled to said base for replaceably supporting a blade only perpendicular to said common plane; wherein said blade supporting means includes means for moving a blade supported thereby in directions parallel to said axes, and in directions transverse to said axes and through said given void, to cause such a supported blade to sweep contactingly, and independently, across one of said wheels to effect honing of one blade-edge side, and across the other of said wheels to effect honing of an opposite blade-edge side;

said blade supporting means further including means for translating a blade supported thereby into and out of proximity with said common plane, to cause said blade-edge sides to contact said wheels at diverse, acute angular displacements from said common plane to cause blade-edge honing along greater and lesser blade-edge depths and with concomitant lesser and greater blade-edge tapering; further including a pair of stropping wheels supported on said base for rotation in parallel axes and on said common plane in a spaced-apart location from said honing wheels;

said stropping wheels being spaced apart to define a void therebetween which is greater than said given void; and means coupled to said stropping wheels for driving said stropping wheels in rotation; wherein said blade moving means comprises means for causing opposite blade-edge sides of a blade supported by said supporting means also to sweep contactingly, and independently, across one of said stropping wheels to effect stropping of only a portion of one blade-edge side, and across the other of said stropping wheels to effect a stropping of only a portion of an opposite blade-edge side;

said honing wheels and said stropping wheels are all of one comon diameter;

said blade translating means comprises first and second means for translating a supported blade into and out of proximity with said common plane; and said first means is selectively operative independent of said second means; and said first and second means have means cooperative for effecting translation of said first means coincident with operation of said second means, whereby operation of said second means effects translation of both said first means and a supported blade.

* * * * *